US006415924B1

(12) United States Patent
Lee

(10) Patent No.: US 6,415,924 B1
(45) Date of Patent: Jul. 9, 2002

(54) TOOL BOX WITH LATERAL SIDES FOR HOLDING MARKED PLATES

(75) Inventor: Wesley Lee, Taichung Hsien (TW)

(73) Assignee: Stanely Chiro International Ltd., Taichung Hsien (TW)

( * ) Notice: Subject to any disclaimer, the term of this patent is extended or adjusted under 35 U.S.C. 154(b) by 0 days.

(21) Appl. No.: 09/974,027

(22) Filed: Oct. 10, 2001

(51) Int. Cl.[7] ..... B65D 79/00

(52) U.S. Cl. ..... 206/459.5; 40/312; 206/373; 220/4.22

(58) Field of Search ..... 206/459.5, 373, 206/372; 220/4.22; 40/312

(56) References Cited

U.S. PATENT DOCUMENTS 3,127,986 A * 4/1964 Hulka ..... 206/459.5
3,679,047 A * 7/1972 Papirnyik ..... 206/459.5
3,878,939 A * 4/1975 Wilcox ..... 206/459.5
3,885,668 A * 5/1975 McClain ..... 206/459.5
4,216,862 A * 8/1980 Daznen ..... 206/459.5
4,620,664 A * 11/1986 Kaufman et al. ..... 206/459.5
4,784,264 A * 11/1988 Sykes ..... 206/459.5
4,789,058 A * 12/1988 Blaney ..... 206/459.5
5,103,978 A * 4/1992 Secor ..... 206/459.5
5,168,998 A * 12/1992 Satoh et al. ..... 206/459.5
5,931,292 A * 8/1999 Focke et al. ..... 206/459.5
6,047,819 A * 4/2000 Borst et al. ..... 206/459.5
6,234,313 B1 * 5/2001 Slevin ..... 206/459.5

* cited by examiner

*Primary Examiner*—Joseph M. Moy
(74) *Attorney, Agent, or Firm*—Harness, Dickey & Pierce, P.L.C.

(57) ABSTRACT

A tool box includes a case body and two side plates. The case body includes base and cover parts. The lateral sides of the base and cover parts have peripheral flanges that extend along the peripheries of the lateral sides to confine cavity halves. The peripheral flanges of the base part have opposite sides formed with first engagement portions. Each of the side plates has a lower portion formed with a second engagement portion that engages releasably a corresponding one of the first engagement portions. The side plates further have outer surfaces adapted to be provided with marks. The lower and upper portions of the side plates are retained in respective cavity halves of the base and cover parts. Stop members project from the peripheral flanges adjacent to the end faces outwardly of the cavities.

5 Claims, 7 Drawing Sheets

TOOL BOX WITH LATERAL SIDES FOR HOLDING MARKED PLATES

BACKGROUND OF THE INVENTION

1. Field of the Invention

The invention relates to a tool box, more particularly to a tool box with lateral sides for holding plates bearing marks, such as trademarks or labels.

2. Description of the Related Art

Referring to FIG. 1, a conventional tool box 1 comprises a base part 101 and a cover part 102 hinged to the base part 101. The base part 101 and the cover part 102 have longitudinal sides 1011, 1021 that are hinged to each other. The cover part 102 is movable to closed and open positions relative to the base part 101. The cover part 102 has a top surface 1022 formed with a trademark 103 in order to enable consumers to recognize the manufacturer of the tool box 1.

In shops and stores, tool boxes 1 are usually stacked one over the other, as shown in FIG. 2, to save space. However, when the stack is above eye level, the consumers cannot see the trademark 103. Furthermore, if the trademark 103 is printed permanently on the cover part 102 of the conventional tool box 1, once the manufacturer decides to change the trademark 103, the conventional tool box 1 has to be replaced totally.

SUMMARY OF THE INVENTION

Therefore, the main object of the present invention is to provide a tool box with lateral sides for holding marked plates in order to overcome the aforementioned drawbacks of the prior art.

Accordingly, a tool box of the present invention comprises a case body and two side plates. The case body includes a base part and a cover part having longitudinal sides that are hinged to each other, and opposite lateral sides that extend transversely of the longitudinal sides. The lateral sides of the base part and the cover part have substantially U-shaped peripheral flanges which respectively extend along the peripheries of the lateral sides to confine cavity halves and which project along directions parallel to the longitudinal sides. The cavity halves are capable of complementing each other when the cover part closes the base part. Each of the peripheral flanges of one of the base part and the cover part has opposite sides formed with first engagement portions. Each of the side plates has a lower portion and an upper portion opposite to the lower portion. A second engagement portion is formed on the lower portion, and engages releasably a corresponding one of the first engagement portions. The side plates further have outer surfaces adapted to be provided with marks. The lower portion is retained in a corresponding one of the cavity halves of the base part. The upper portion is retained in a corresponding one of the cavity halves of the cover part. The peripheral flanges respectively have outer end faces outwardly of the cavities. Stop members project from the peripheral flanges adjacent to the end faces.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
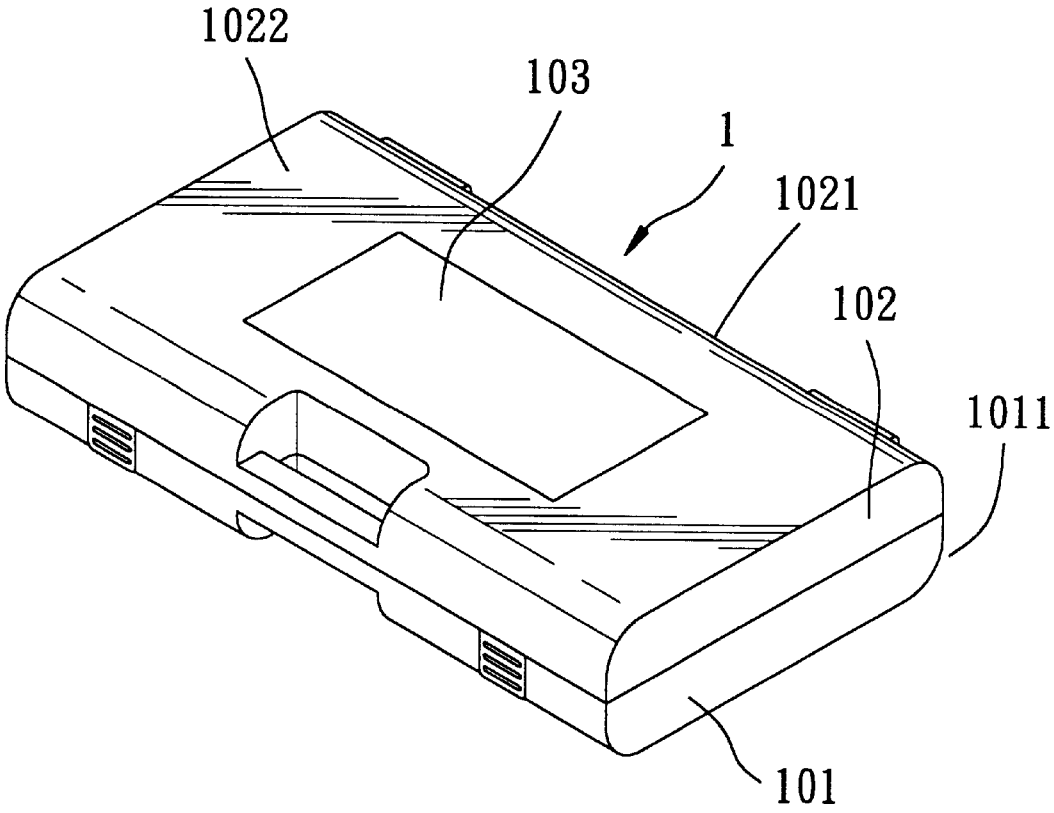
FIG. 1 PRIOR ART
FIG. 1 is a perspective view of a conventional tool box.
Figure 2:
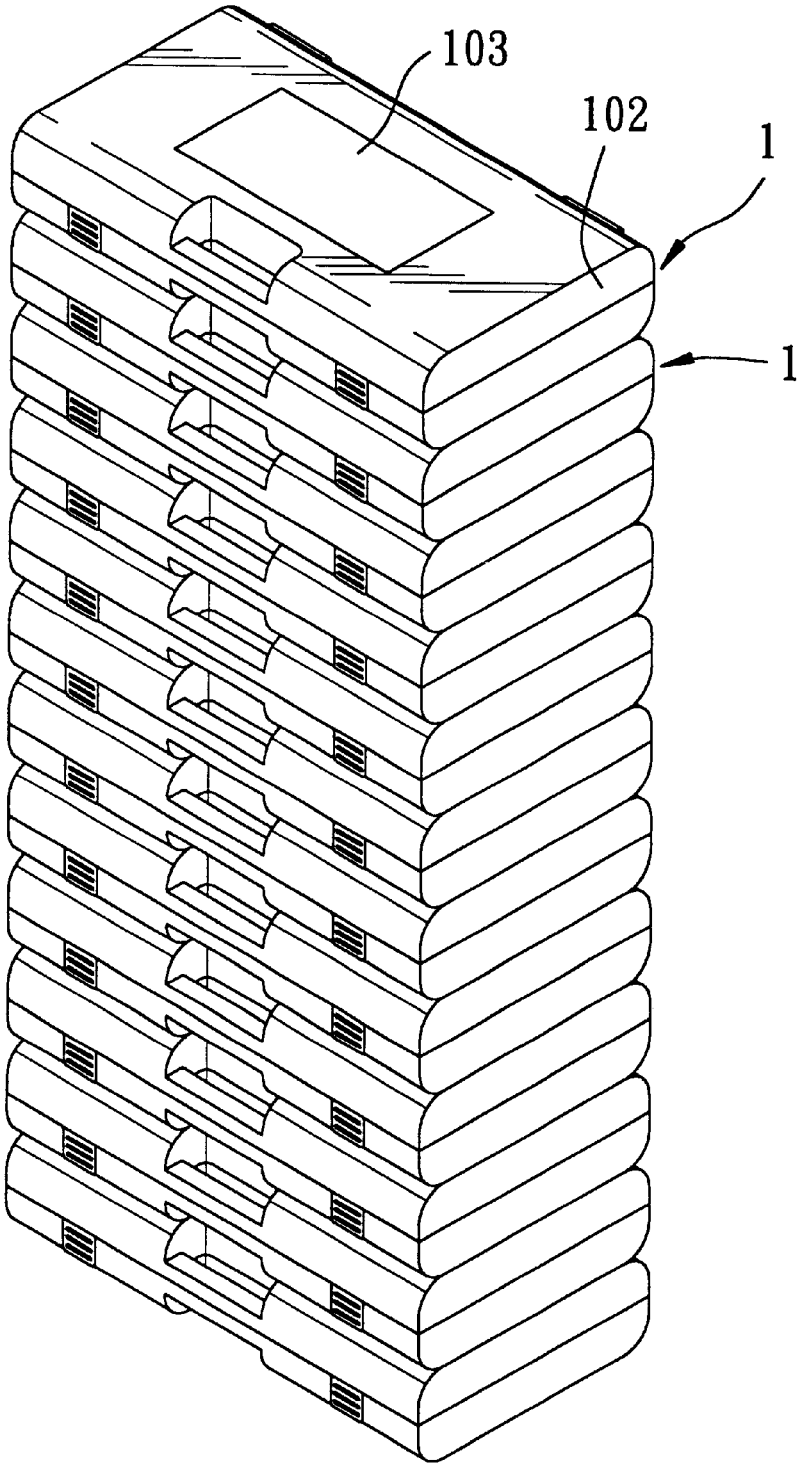
FIG. 2 PRIOR ART
FIG. 2 is another perspective view showing a stack of conventional tool boxes.

Before the present invention is described in greater detail, it should be noted that like elements are denoted by the same reference numerals throughout the disclosure.

Figure 3:
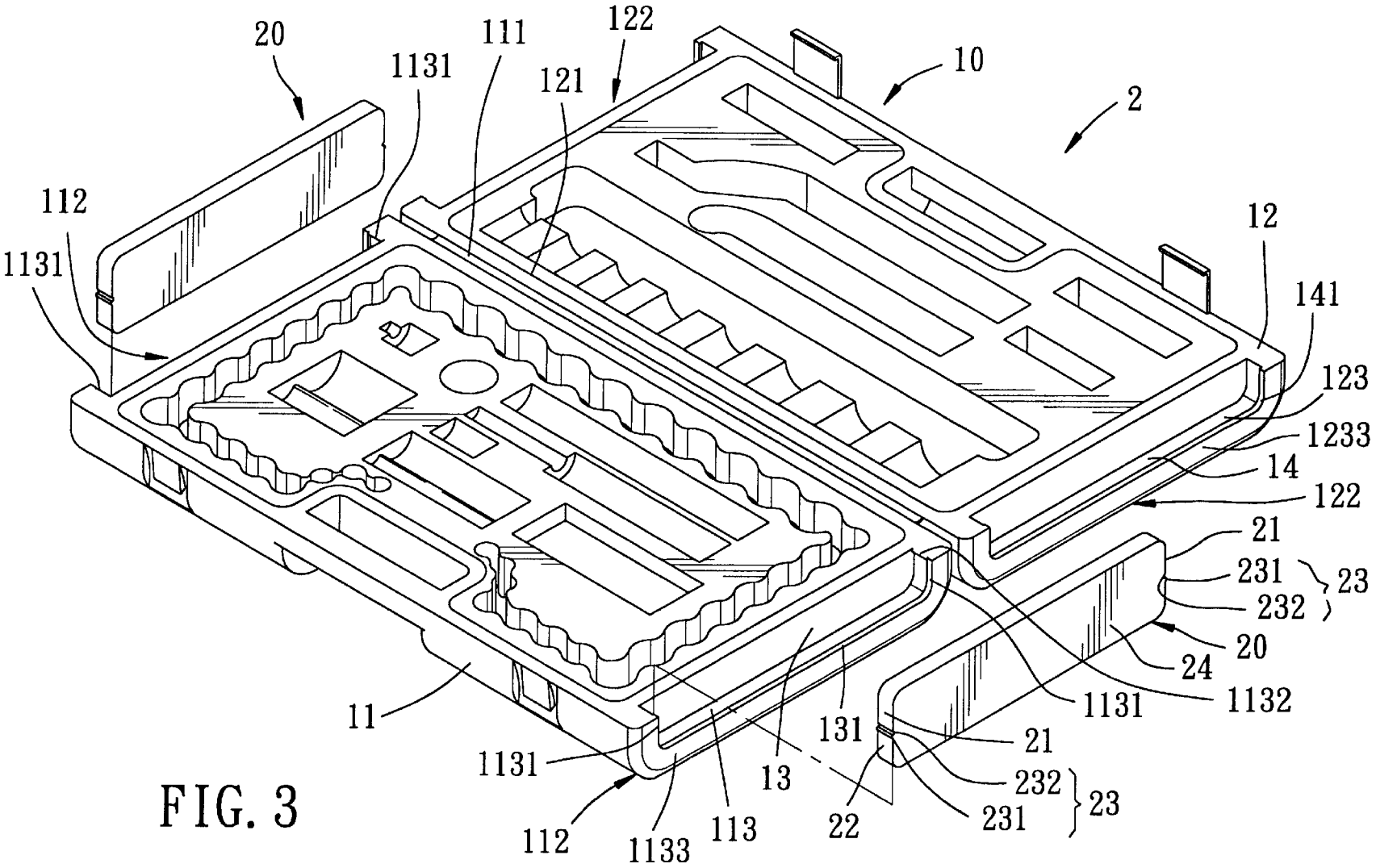
FIG. 3 is a perspective view of the first preferred embodiment of a tool box according to the present invention in an open state.
Figure 4:
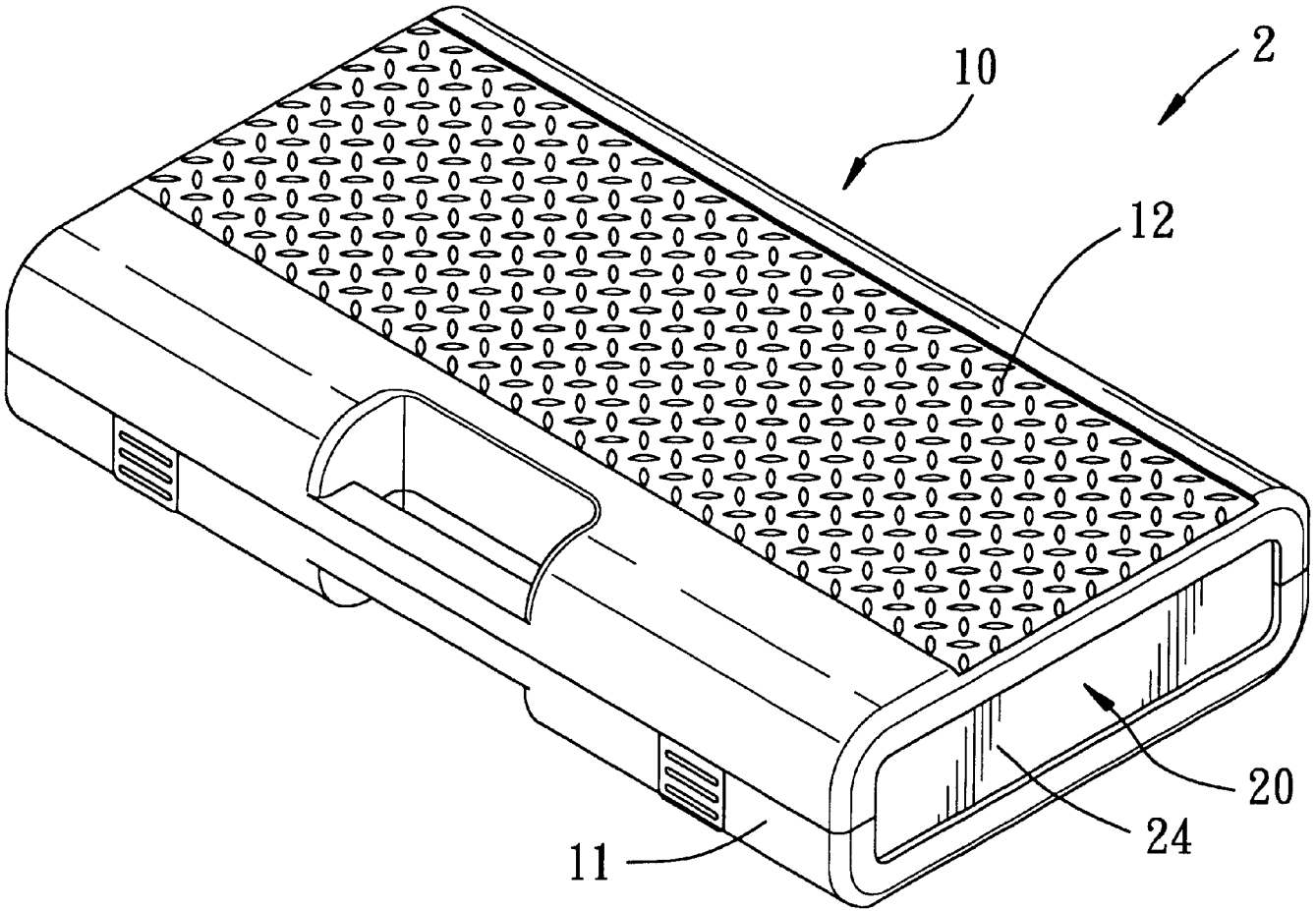
FIG. 4 is another perspective view of the tool box of FIG. 3 in a closed state.
Figure 5:
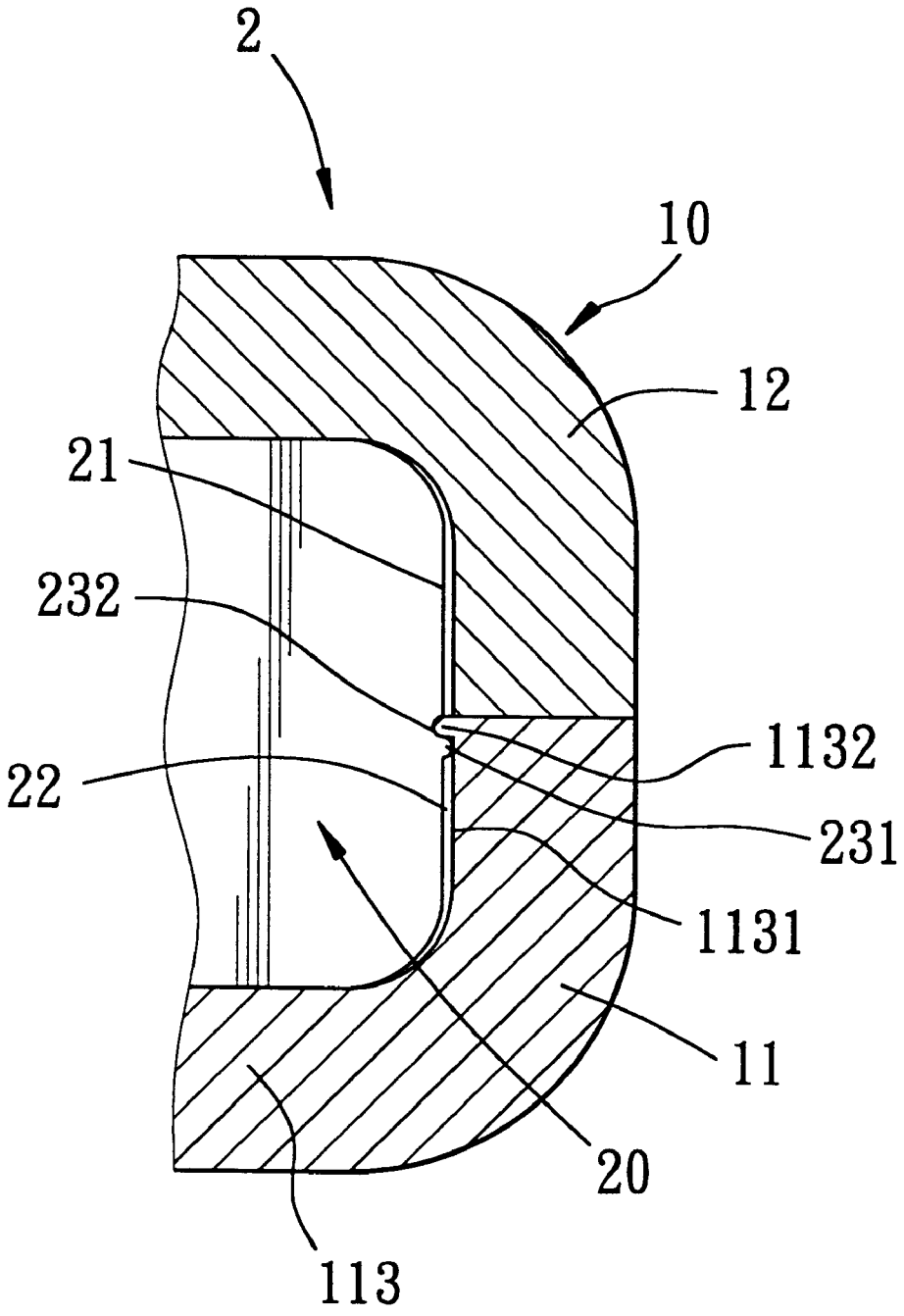
FIG. 5 is a fragmentary cross-sectional view illustrating how engagement portions of a side plate and a base part are inter-engaged.

Referring to FIGS. 3, 4 and 5, the first preferred embodiment of a tool box 2 according to the present invention is shown to comprise a case body 10 and two side plates 20. The unicolored rectangular case body 10 includes a base part 11, a cover part 12 hinged to the base part 11, and a receiving space between the base part 11 and the cover part 12 for receiving tools (not shown). The base part 11 and the cover part 12 have longitudinal sides 111, 121 that are hinged to each other, and opposite lateral sides 112, 122 that extend transversely of the longitudinal sides 111, 121. The cover part 12 is movable between closed and open positions relative to the base part 11. The lateral sides 112, 122 of the base part 11 and the cover part 12 have substantially U-shaped peripheral flanges 113, 123 which respectively extend along the peripheries of the lateral sides 112, 122 to confine cavity halves 13, 14 and which project along directions parallel to the longitudinal sides 111, 121. The cavity halves 13, 14 complement with each other to receive the side plates 20, respectively, when the cover part 12 closes the base part 11. In this embodiment, each of the peripheral flanges 113 of the base part 11 has opposite sides 1131 formed with first engagement portions in the form of protrusions 1132.

Each of the rectangular side plates 20 has a strong contrasting color with the case body 10, and includes a lower portion 22 and an upper portion 21 opposite to the lower portion 22. Second engagement portions 23 are formed on two opposite sides of the lower portion 22. In this embodiment, each of the second engagement portions 23 includes a groove 232 and a protuberance 231 below the groove 232. The grooves 232 engage respectively and releasably the protrusions 1132 on the peripheral flanges 113. The protuberances 231 engage the peripheral flanges 113 below the protrusions 1132. As such, each side plate 20 is fixed in the cavity half 13 at one of the lateral sides 112 of the base part 11. The side plates 20 further have outer surfaces 24 respectively formed with trademarks (not shown).

When the cover part 12 closes the base part 11, the lower portion 22 of each of the side plates 20 is retained in the cavity half 13 of the base part 11 and the upper portion 21 is retained in the cavity half 14 of the cover part 12. The peripheral flanges 113, 123 respectively have outer end faces 1133, 1233 outwardly of the cavities 13,14. Stop members 131, 141 project from the peripheral flanges 113, 123 adjacent to the end faces 1133, 1233 along directions parallel to the end faces 1133, 1233.

To attach each of the side plates 20 on the case body 10, the cover part 12 is opened initially, and each of the side plates 20 is forced downwardly into the corresponding cavity half 13 of the base part 11. It should be noted that the trademarks (not shown) on the side plates 20 are visible from the opposite lateral sides 112, 122 of the case body 10. To detach the side plates 20 off the case body 10, the base part 11 is held downwardly and each of the side plates 20 is pulled upwardly by force.

Figure 6:
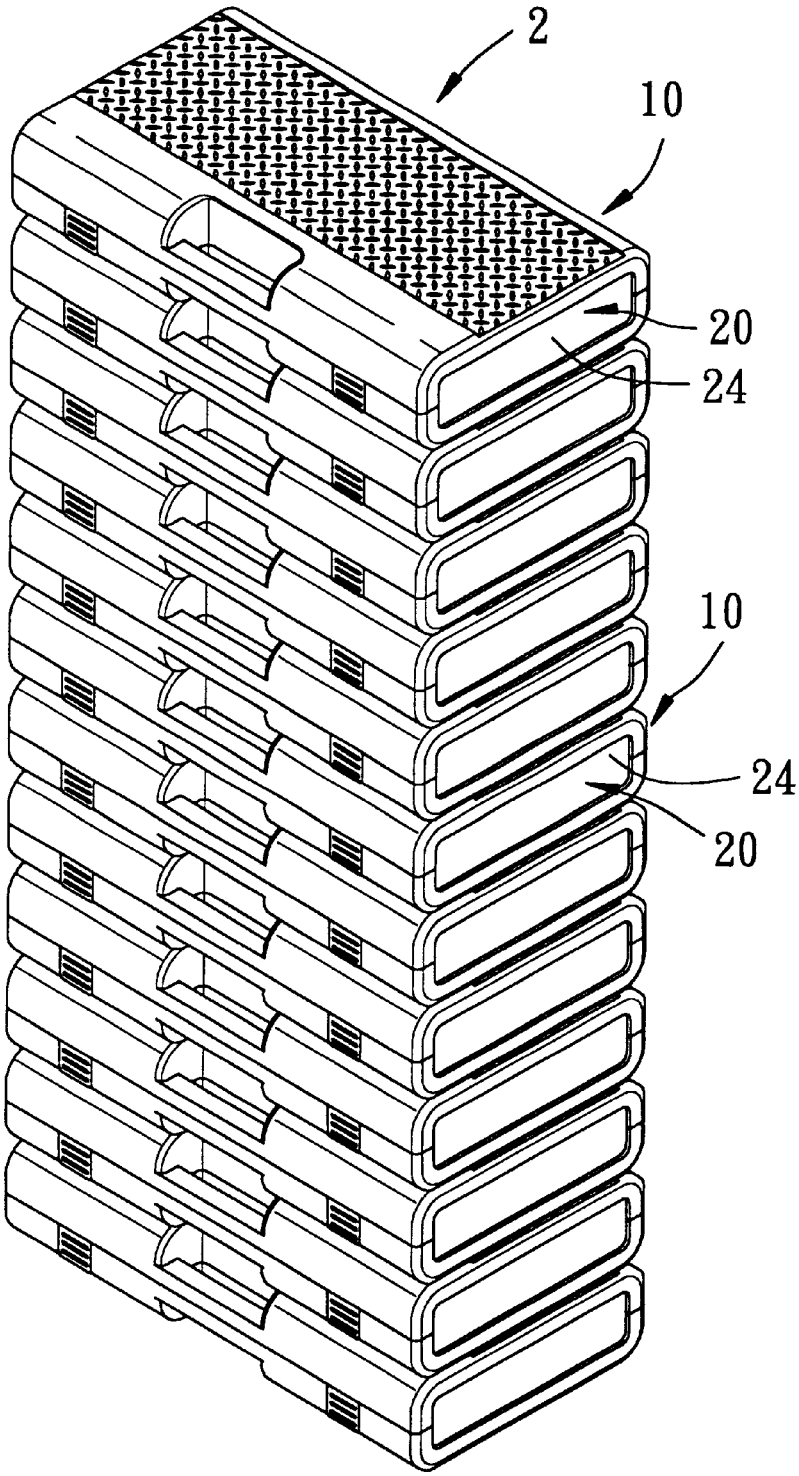
FIG. 6 is a perspective view showing a number of tool boxes of FIG. 3 arranged in a stack.

The tool box 2 of the present invention has trademarks (not shown) that can be seen from the opposite lateral sides 112, 122. As such, when a number of tool boxes 2 are stacked to a height above eye level, as shown in FIG. 6, the consumers can still see the trademarks. Furthermore, if the manufacturer decides to change the trademark, it is necessary to replace only the side plates 20.

Figure 7:
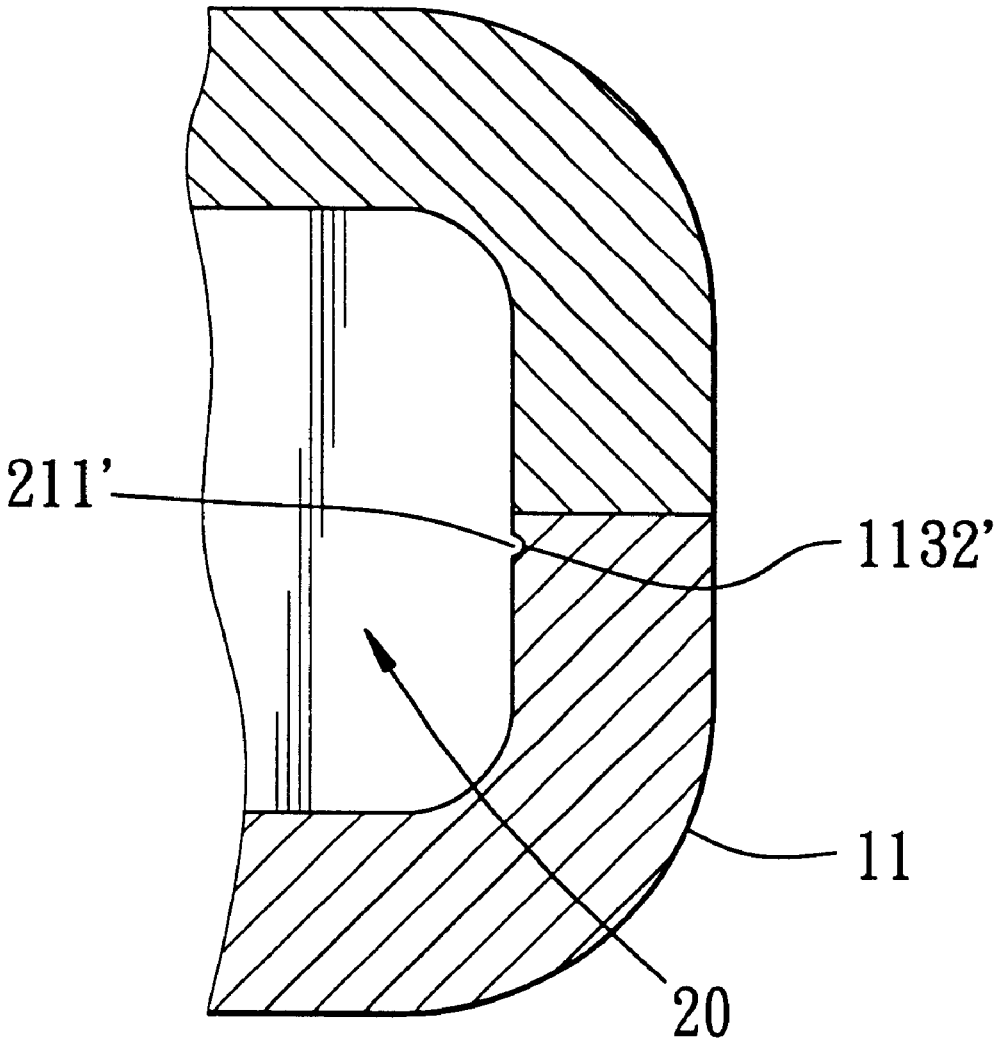
FIG. 7 is a fragmentary cross-sectional view of the second preferred embodiment of the tool box according to the present invention.

Referring to FIG. 7, the second preferred embodiment of the tool box according to the present invention is shown to be substantially similar to the first preferred embodiment except that each first engagement portion on the base part 11 includes a groove 1132' to engage a corresponding protrusion 211' provided on one side of each side plate 20.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A tool box comprising:

a case body including a base part and a cover part, said base part and said cover part having longitudinal sides that are hinged to each other, and opposite lateral sides that extend transversely of said longitudinal sides, said lateral sides of said base part and said cover part having substantially U-shaped peripheral flanges which respectively extend along the peripheries of said lateral sides to confine cavity halves and which project along directions parallel to said longitudinal sides, said cavity halves being capable of complementing each other when said cover part closes said base part, each of said peripheral flanges of one of said base part and said cover part having opposite sides formed with first engagement portions; and two side plates, each of which has a lower portion and an upper portion opposite to said lower portion, a second engagement portion being formed on said lower portion for engaging releasably a corresponding one of said first engagement portions, said side plates further having outer surfaces adapted to be provided with marks, wherein said lower portion is retained in a corresponding one of said cavity halves of said base part, and said upper portion is retained in a corresponding one of said cavity halves of said cover part, said peripheral flanges respectively having outer end faces outwardly of said cavities, and stop members projecting from said peripheral flanges adjacent to said end faces.

2. The tool box of claim 1, wherein said first engagement portions are formed on said peripheral flanges of said base part.

3. The tool box of claim 2, wherein each of said first engagement portions includes a protrusion, each of said second engagement portions including a groove engageable with said protrusion.

4. The tool box of claim 3, wherein each of said second engagement portions on said side plates further includes a protuberance below said groove.

5. The tool box of claim 2, wherein each of said first engagement portions includes a groove, each of said second engagement portions on said side plates including a protrusion engageable with said groove.

* * * * *

UNITED STATES PATENT AND TRADEMARK OFFICE

CERTIFICATE OF CORRECTION

PATENT NO. : 6,415,924 B1
DATED : July 9, 2002
INVENTOR(S) : Wesley Lee

It is certified that error appears in the above-identified patent and that said Letters Patent is hereby corrected as shown below:

Title page,
Item [73], Assignee, change "Stanely Chiro International Ltd." to -- Stanley Chiro International Ltd.. --.

Signed and Sealed this

Thirty-first Day of January, 2006

JON W. DUDAS
*Director of the United States Patent and Trademark Office*